US007627546B2

(12) United States Patent
Moser et al.

(10) Patent No.: US 7,627,546 B2
(45) Date of Patent: Dec. 1, 2009

(54) RAILCAR CONDITION INSPECTION DATABASE

(75) Inventors: William Eugene Moser, Omaha, NE (US); Tim Donahue, Wheaton, IL (US); Chuck Smailes, Homewood, IL (US); Rick Blaige, Deerfield, IL (US)

(73) Assignee: General Electric Railcar Services Corporation, Chicago, IL (US)

( * ) Notice: Subject to any disclaimer, the term of this patent is extended or adjusted under 35 U.S.C. 154(b) by 0 days.

(21) Appl. No.: 10/075,065

(22) Filed: Feb. 13, 2002

(65) Prior Publication Data

US 2002/0188593 A1 Dec. 12, 2002

(51) Int. Cl.
*G06F 7/00* (2006.01)
*G06F 17/30* (2006.01)

(52) U.S. Cl. ..... 707/1

(58) Field of Classification Search ..... 707/1–10, 707/100, 101, 104.1; 705/1, 29, 35; 340/172; 364/550; 264/449.1, 122 R; 701/19; 246/182
See application file for complete search history.

(56) References Cited

U.S. PATENT DOCUMENTS 3,944,986 A * 3/1976 Staples ..... 104/88.04
5,786,998 A * 7/1998 Neeson et al. ..... 701/35
5,836,529 A * 11/1998 Gibbs ..... 246/122 R
5,867,404 A * 2/1999 Bryan ..... 714/724
5,953,707 A * 9/1999 Huang et al. ..... 705/10
5,956,664 A * 9/1999 Bryan ..... 702/184
6,135,396 A * 10/2000 Whitfield et al. ..... 246/182 R
6,308,120 B1 * 10/2001 Good ..... 701/29
6,345,257 B1 * 2/2002 Jarrett ..... 705/1
6,470,303 B2 * 10/2002 Kidd et al. ..... 703/8
6,477,452 B2 * 11/2002 Good ..... 701/29
6,480,121 B1 * 11/2002 Reimann ..... 340/990
6,511,023 B2 * 1/2003 Harland ..... 246/122 R
6,597,973 B1 * 7/2003 Barich et al. ..... 701/29
6,622,264 B1 * 9/2003 Bliley et al. ..... 714/26
6,691,064 B2 * 2/2004 Vroman ..... 702/183
6,832,183 B1 * 12/2004 Barich et al. ..... 703/22
6,955,100 B1 * 10/2005 Barich et al. ..... 73/865.8
6,957,257 B1 * 10/2005 Buffalo et al. ..... 709/224
6,959,235 B1 * 10/2005 Abdel-Malek et al. ..... 701/33
6,961,682 B2 * 11/2005 Doner ..... 703/2
6,996,498 B2 * 2/2006 Pierro et al. ..... 702/184
7,006,957 B2 * 2/2006 Doner ..... 703/6
7,073,753 B2 * 7/2006 Root et al. ..... 246/72

(Continued)

OTHER PUBLICATIONS

U.S. Dept.of transportation. Event Recorders for Rail Rapid Transit Systems. FTA-VA-26-7004-98-1. Jun. 1998.*

(Continued)

*Primary Examiner*—John E Breene
*Assistant Examiner*—Aleksandr Kerzhner
(74) *Attorney, Agent, or Firm*—McDermott Will & Emery LLP

(57) ABSTRACT

The present invention relates to a system and a method for inspecting rail equipment, such as, for example, railcars, utilizing a data entry system to track, inventory and generate reports related to the stored railcar equipment, and storing the information within a database. Specifically, the system and method includes a standardized inspection process that may assess a condition of a particular piece of rail equipment. Moreover, the data entry system may query a user to input the condition information, and any other information, into a database. The information may be utilized to generate reports as to the condition of the railcar equipment, an estimated cost of repair for the railcar equipment, the location of the railcar equipment, and the disposition of the railcar equipment.

11 Claims, 9 Drawing Sheets

U.S. PATENT DOCUMENTS

| | | | | |
|---|---|---|---|---|
| 2001/0029411 | A1* | 10/2001 | Hawthorne | 701/19 |
| 2001/0032105 | A1 | 10/2001 | Frye et al. | |
| 2002/0013685 | A1* | 1/2002 | Kidd et al. | 703/8 |
| 2002/0022969 | A1 | 2/2002 | Berg et al. | |
| 2002/0059075 | A1 | 5/2002 | Schick et al. | |
| 2002/0087419 | A1* | 7/2002 | Andersson et al. | 705/26 |
| 2005/0171661 | A1* | 8/2005 | Abdel-Malek et al. | 701/33 |

OTHER PUBLICATIONS

Fasn Zhang and Andrew K.S. Jardine. Optimal Maintenance models with minimal repair, periodic overhaul and complete renewal. IIE Transactions (Jul. 1998).*

* cited by examiner

FIG. 2

Box Car Condition Report

Date : MM/DD/YY
Time : TT:TT:TT

Car Numb: ____ _____ Inspector: _____ Inspection Location: _____
Date: _____ Storage Location: _____
Upmarket per SOW ? : _____ SOW Number: _____ *SOW = Scope of Work

---

| | | |
|---|---|---|
| Car Body | Side sheet dents | : _____ |
| | Broken welds | : _____ |
| | Car Body Corrosion | : _____ |
| | End sheets bowed more than 4" | : _____ |
| | Side post interference with door oper | : _____ |
| | Evidence of roof leakage | : _____ |
| Lading | Car equipped with lading anchors Y/N | : _____ |
| | Car equipped with load dividers Y/N | : _____ |
| | Load dividers inoperable | : _____ |
| Floor | Broken or missing floor boards | : _____ |
| | Light showing through floor | : _____ |
| | Protrusions | : _____ |
| | Dents greater than 1 inch | : _____ |
| | Missing caulk | : _____ |
| | Contamination - leaks, odors, dirt, old cmd | : _____ |
| | Old commodity | : _____ |
| Interior Walls | Large dented areas | : _____ |
| | Loose, broken welds | : _____ |
| | Sharp edge or protrusions over 1/8 | : _____ |
| | End lining bent over 4" | : _____ |
| | Lining contamination - leaks, odors, dirt | : _____ |
| Doors | Bent or broken door track & retainers | : _____ |
| | Missing hardware | : _____ |
| | Door leaks | : _____ |
| | Inoperable | : _____ |
| Cushioning | Defective cushioning or draft units | : _____ |
| Trucks | Friction casting wedge rise | : _____ |
| | Worn gibs | : _____ |
| | Broken springs | : _____ |
| | Defective center plate | : _____ |
| Structural | Center sill bent | : _____ |
| Exterior Paint | Customer logo's | : _____ |
| | Graffiti | : _____ |
| | Paint condition | : _____ |
| Interchange Defects | | : _____ |
| Overall Condition | | : _____ |
| Repair Disposition | | : _____ |

Comments:

FIG. 3

Hopper Car Condition Report

Date : MM/DD/YY
Time : TT:TT:TT

Car Numb: _____ Inspector: _____ Inspection Location: _____
Date: _____ Storage Location: _____
Upmarket per SOW ? : _____ SOW Number: _____ *SOW = Scope of Work

---

| | | |
|---|---|---|
| Car Body | Side sheet dents | : _____ |
| | Broken or loose running boards | : _____ |
| | Broken Welds | : _____ |
| | Corrosion | : _____ |
| | Missing, broken, loose vibrator casting | : _____ |
| Lading | Leaking gates / hatches | : _____ |
| | Abrasions or cut gaskets | : _____ |
| | Broken hatch covers | : _____ |
| Lining | Car lined ? Y/N : | Lining Date : MM/DD/CCYY |
| | Lining Condition | : _____ |
| | Rust bleed | : _____ |
| | Loose or flaking areas | : _____ |
| | Stains or discoloration | : _____ |
| Interior | Evidence of leaks | : _____ |
| | Broken partition welds | : _____ |
| | Old commodity | : _____ |
| | Rust | : _____ |
| Condemnation | | : _____ |
| | Porosity, undercut welds | : _____ |
| | Intermittent or caulked welds | : _____ |
| | Suitable for lining? Y/N | : _____ |
| Trucks | Friction casting wedge rise | : _____ |
| | Worn gibs | : _____ |
| | Broken springs | : _____ |
| | Defective center plate | : _____ |
| Structural | Center sill bent | : _____ |
| Exterior Paint | Customer Logo's | : _____ |
| | Graffiti | : _____ |
| | Commodity spillage | : _____ |
| | Paint condition | : _____ |
| Interchange Defects | | : _____ |
| Overall Condition | | : _____ |
| Repair Disposition | | : _____ |
| Comments: | | |

General Purpose Tank Car Condition Report

Date: MM/DD/YY
Time: TT:TT:TT

Car Numb: Inspector: Inspection Location:
Date: MM/DD/CCYY Storage Location :
Upmarket per SOW ? : SOW Number:

---

Car Body Shell bent or buckled :
Jacket bent,buckled or corroded :
Bottom Outlet Valve
Require application of skid protection:
Missing or defective caps and chains :
Top Valves and Accessories
Missing or non-approved valves :
Corroded or inoperative valves :
Require eduction pipe reinforcement : Y/N
Gaskets Gaskets worn,broken or missing :
Lining Car lined ? Y/N : Lining Date = MM/DD/CCYY
Lining Condition :
Rust bleed :
Loose or flaking areas :
Stains or discoloration :
Interior Rust :
Corrosion :
Interior residue or film :
Water present :
Linable condition Suitable for lining? Y/N :
Require weld overlay repair :
Requires tank insert repairs :
Porosity,undercut welds :
Brackets,sharp edges or transitions :
Trucks Friction casting wedge rise :
Worn gibs :
Broken springs :
Defective center plate :
Structural Center or stub sill bent :
Exterior Paint Customer Logo's :
Graffiti :
Commodity spillage :
Paint Condition :
Interchange Defects :
Overall Condition :
Comments:

FIG. 4

FIG. 5

Open Top Hooper & Gondola a Car Condition Report

Date : MM/DD/YY
Time : TT:TT:TT

Car Numb: ____ _____ Inspector: _____ Inspection Location: _____
Date: _____ Storage Location: _____
Upmarket per SOW ? : _____ SOW Number: _____ *SOW = Scope of Work

---

| | | |
|---|---|---|
| Car Body | End and side sheets broken | : _____ |
| | End and side sheets bowed | : _____ |
| | Top chords bowed | : _____ |
| | Broken welds | : _____ |
| | Corrosion | : _____ |
| Lading | Leaking gates | : _____ |
| | Gates inoperable | : _____ |
| Interior | Broken floor sheets | : _____ |
| | Broken supports | : _____ |
| | Broken corner caps | : _____ |
| | Interior corrosion | : _____ |
| | Old Commodity | : _____ |
| Trucks | Friction casting wedge rise | : _____ |
| | Worn gibs | : _____ |
| | Broken springs | : _____ |
| | Defective center plate | : _____ |
| Structural | Center sill bent | : _____ |
| Exterior Paint | Customers Logo's | : _____ |
| | Graffiti | : _____ |
| | Commodity spillage | : _____ |
| | Paint condition | : _____ |
| Interchange Defects | | : _____ |
| Overall Condition | | : _____ |
| Repair Disposition | | : _____ |

Comments

Plastic Pellet Car Condition Report

Date: MM/DD/YY
Time: TT:TT:TT

Car Numb: Inspector: Inspection Location:
Date: MM/DD/CCYY Storage Location :
Upmarket per SOW ? : SOW Number:

---

Car Body Side sheet dents and/or hammer marks :
Broken Welds :
Corrosion :
Roof sheet buckles :
Outlet Gates Gates need upgrade modification :
Gates difficult to operate, need att. :
Missing or defective hardware :
Gates & tubes req. buffing/other attn. :
Hatch Covers Require vented hatch covers :
Hatch covers req. latch upgrade :
Broken hatch covers :
End vents require attention :
Manway rings req. buffing/other attn. :
Hatch cover gaskets requires attn. :
Lining Car lined ? Y/N : Lining Date : MM/DD/CCYY
Lining condition :
Rust bleed :
Loose or flaking areas :
Stains or discoloration :
Interior Evidence of leaks :
Broken partition welds :
Old commodity :
Rust :
Condensation :
Porosity undercut welds :
Brackets, sharp edges or transitions :
Intermittent or caulked welds :
Deep discoloration from old commodity :
Suitable for lining ? :
Vents Vents req. modification/ other attn. :
Trucks Friction casting wedge rise :
Worn gibs :
Broken springs :
Defective center plate :
Structural Center sill bent :
Exterior Paint Customer logo :
Graffiti :
Commodity spillage :
Paint condition :
Interchange Defects :
Overall Condition :
Repair Disposition :
Comments:

FIG. 6

Pressure Differential Car Condition Report Date: MM/DD/YY
Time: TT:TT:TT

Car Numb: Inspector: Inspection Location:
Date: MM/DD/CCYY Storage Location :
Upmarket per SOW ? : SOW Number:

---

Car Body Side sheet dents and/or hammer marks :
Broken or loose running :
Broken welds :
Corrosion :
Roof sheet buckles :
Outlet System Bone gage box & hardware :
Defective piping, couplings & swivels :
Butterfly valves broken/sign of leakage:
Defective blow down :
Missing/defective pipe caps & gaskets :
Wet and/or dirty aerator pads :
Broken or stained aerator pads :
Hatch Covers Defect/missing hatch cover hardwar:
Defective/missing hatch cover gaskets :
Broken hatch covers :
Lining Car lined ? Y/N : Lining Date : MM/DD/CCYY
Rust bleed :
Loose or flaking areas :
Stains or discoloration :
Lining Condition :
Interior Evidence of Leaks :
Old commodity :
Rust :
Condensation :
Porosity undercut welds :
Brackets, sharp edges or transitions :
Intermittent or caulked welds :
Deep discoloration from old commodity :
Suitable for lining ? :
Trucks Friction casting wedge rise :
Worn gibs :
Broken springs :
Defective center plate :
Structural Center sill bent :
Exterior Paint Customer logo :
Graffiti :
Commodity spillage :
Paint condition :
Interchange Defects :
Overall Condition :
Repair Disposition :

Comments:

FIG. 7

FIG. 8

Pressure Tank Car Condition Report

Date : MM/DD/YY
Time : TT:TT:TT

Car Numb: _____ _____ Inspector: _____ Inspection Location: _____
Date: _____ Storage Location: _____
Upmarket per SOW ? : _____ SOW Number: _____ *SOW = Scope of Work

---

| | | |
|---|---|---|
| Car Body | Shell bent or buckled | : _____ |
| | Jacket bent, buckled or corroded | : _____ |
| | Corrosion | : _____ |
| | Roof sheet buckles | : _____ |
| Top Valves & Accessories | | |
| | Missing or non-approved valves | : _____ |
| | Corroded or inoperative valves | : _____ |
| | Missing or defective plugs and chains | : _____ |
| Gaskets | Gaskets worn, broken or missing | : _____ |
| Interior | Rust | : _____ |
| | Corrosion | : _____ |
| | Interior residue or film | : _____ |
| Trucks | Friction casting wedge rise | : _____ |
| | Worn gibs | : _____ |
| | Broken Springs | : _____ |
| | Defective center plate | : _____ |
| Structural | Center or stub sill bent | : _____ |
| Exterior Paint | Customer Logo | : _____ |
| | Graffiti | : _____ |
| | Commodity spillage | : _____ |
| | Paint condition | : _____ |
| Exterior Coating | Exterior cleaning req. (DOT) | : _____ |
| | Thermobond protection | : _____ |
| | Thermobond protection repairs | : _____ |
| Interchange Defects | | : _____ |
| Overall Condition | | : _____ |
| Comments | | |

_Condition_Form

Date : MM/DD/YY
Time : TT:TT:TT

Car Number: ____ _____ Inspector: _____ Inspection Location: ___
Date: _____ Storage Location: _____
Upmarket per SOW ? ___ SOW Number: _____ *SOW = Scope of Work

---

| | | |
|---|---|---|
| Car_Body: | Side sheet dents | : _____ |
| | Broken welds | : _____ |
| | Car body corrosion | : _____ |
| Lading: | **Trailer Hitches** | : _____ |
| | **Tie Down and Load Restraining Devices** | : _____ |
| Floor: | Broken or missing flooring | : _____ |
| Cushioning: | Defective cushioning or draft units | : _____ |
| Trucks: | Friction casting wedge rise | : _____ |
| | Worn gibs | : _____ |
| | Broken Springs | : _____ |
| | Defective center plate | : _____ |
| Structural: | Center sill bent | : _____ |
| Exterior_Paint: | Customer logo's | : _____ |
| | Graffiti | : _____ |
| | Paint condition | : _____ |
| Interchange: | Defects | : _____ |
| Overall_Condition: | | : _____ |
| Repair_Disposition: | | : _____ |
| Comments: | | |

FIG. 9

RAILCAR CONDITION INSPECTION DATABASE

FIELD OF INVENTION

The present invention relates to a system and a method for utilizing a data entry system to record conditions of out of service products and equipment that have been inspected via an inspection process. More specifically, the present invention relates to a system and a method that allows an individual to enter qualitative information into a database relating to conditions of rail equipment, such as, for example, railcars, that thereby quantifiably generates an estimated cost of repair. The data system may allow for the collection and maintenance of condition assessments on out-of-service railcars thereby providing a condition inventory to source rail equipment for new orders in a timely and economical manner. The database, therefore, stores information relating to a plurality of railcars, including their repair conditions. The information is recalled as a printable report when necessary.

BACKGROUND OF THE INVENTION

Rail equipment, of course, is utilized to transport known quantities over great distances. In addition, a plurality of different types of railcars can be utilized depending on the particular product that is to be transported. For example, pressurized and/or liquefied gases may be transported via a pressurized tank car. Moreover, hopper-type railcars may be utilized for transporting grains or other food products. Over time, however, rail equipment can become damaged and may be discontinued due to neglect, age, and/or any other reason. When railcars are no longer used and/or useable, they are typically stored in a depot or other storage area where they may sit for long periods of time.

Companies that utilize many railcars over a plurality of years typically have many such railcars and other rail equipment stored in depots or other storage areas. However, many of these railcars and rail equipment may be useable if repaired or otherwise maintained. Specifically, railcars that may have been discontinued at one time or damaged without being repaired can easily be repaired or otherwise maintained at a later date if needed. Further, over time companies may wish to utilize the stored rail equipment for new and/or different purposes. However, it is difficult to track and otherwise keep a record of the conditions of the railcars that are being stored in depots or other storage areas, especially when there is a particularly large number of railcars in storage. Further, it is difficult to identify railcars that may be useable for particular purposes due to the difficulty of identifying and keeping a record of the rail equipment and types of railcars, the conditions of the railcars, and the costs of repairing the rail equipment.

Therefore, a system and a method for inspecting stored equipment and keeping information generated by an inspection is necessary to overcome the deficiencies noted above. Specifically, a data entry system and a method for utilizing the system are necessary. The data entry system may be utilized to store, track, inventory and generate reports that may detail locations of the stored equipment, the conditions of the stored products, estimated costs of repairing and/or maintaining the stored products and/or any other function.

The database, therefore, stores the information and provides a record of the inventory and condition of the rail equipment thereby allowing an entity such as a corporation to use rail equipment that best fits a customer's needs rather than spending unnecessary dollars preparing less optimal railcar equipment or purchasing new railcar equipment. Moreover, the database allows rail equipment to be identified and prepared using mobile repair units thereby saving freight and other shop expense. Further, the database allows an entity to deliver the railcar equipment to a customer faster.

SUMMARY OF THE INVENTION

The present invention relates to a system and a method for inspecting rail equipment, such as, for example, railcars, utilizing a data entry system to track, inventory and generate reports related to the stored rail equipment. In addition, the information may be stored within a database. Specifically, the system and method includes a standardized inspection process that may assess a condition of a particular piece of rail equipment. Moreover, the data entry system may query a user to input the condition information, and any other information, into the database.

The present invention provides an inspection process for inspecting rail equipment such as, for example, railcars, that generates information relating to the condition of the rail equipment that is specific to the type of railcar. Moreover, the present invention provides a systematic inspection process that allows an inspector to quickly and efficiently review a railcar to determine the condition of the railcar.

Further, the present invention provides a data entry system for inputting information relating to the condition of the railcar into a database for storage and for the generation of reports. Moreover, the present invention provides a data entry system that transforms qualitative information relating to the condition of the railcar into quantitative data by generating a repair cost estimate after the information relating to the condition of the railcar is input into the data entry system.

Still further, the present invention provides a data entry system that calculates whether a railcar can be submitted to a customer "as-is", whether a mobile repair unit may be utilized to repair the railcar, or whether the railcar should be sent to a repair shop to repair major damage. The present invention also provides a database for storing the information relating to the condition of the railcars.

Additional features and advantages of the present invention are described in and will be apparent from, the detailed description of the presently preferred embodiments.

BRIEF DESCRIPTION OF THE FIGURES

FIGS. 2-9 illustrate report forms for each type of railcar that are output by the database system indicating a disposition for each type of railcar.

DETAILED DESCRIPTION OF THE PRESENTLY PREFERRED EMBODIMENTS

Figure 1:
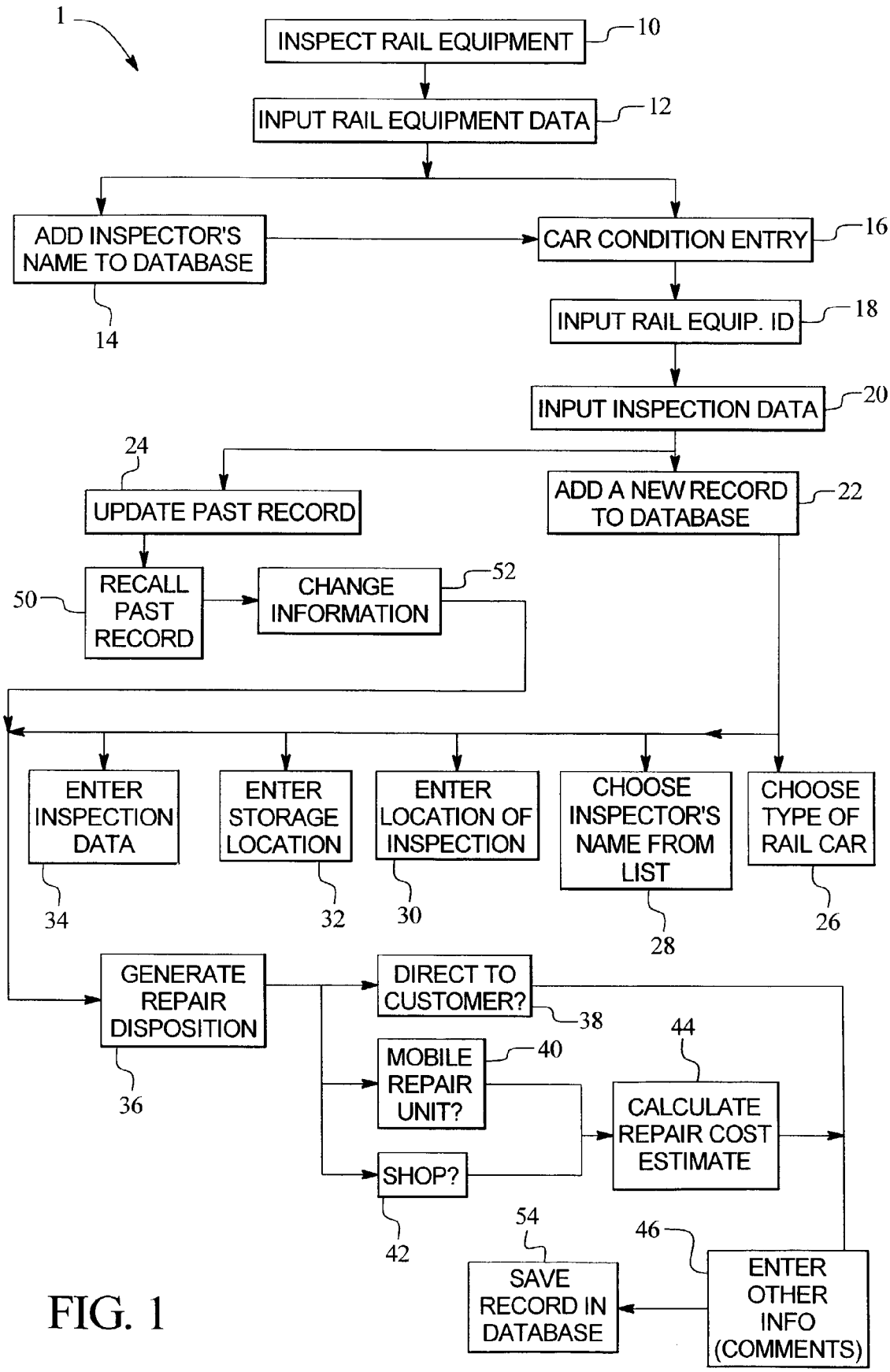
FIG. 1 illustrates a process 1 for inspecting a railcar and inputting information into a database for disposition of the railcar.

The present invention relates to a system and a method for inspecting rail equipment, such as, for example, railcars, utilizing a data entry system to track, inventory and generate reports related to the stored railcar equipment and storing the information within a database. Specifically, the system and method may include a standardized inspection process that may assess a condition of a particular piece of rail equipment. Moreover, the data entry system may query a user to input the condition information, and any other information, into the database. The information may be utilized to generate reports as to the estimated cost of repair, the location of the rail equipment and the disposition of the railcar.

FIG. 1 illustrates a process 1 demonstrating an embodiment of the present invention. Generally, the system and the method may include an inspection process that may be utilized to generate an assessment of the railcar equipment. Specifically, the inspection process may include an "Inspect Rail Equipment" step 10. Although any type of rail equipment may be inspected and stored within the database, the present invention is particularly well suited for inspecting and storing information related to different types of railcars. The status of each railcar may be generated via the inspection process and may be manually noted on forms within a data entry system that may be interconnected with the database. The forms may be made available through a menu option.

The inspection step 10 may take any amount of time that may be apparent to one having ordinary skill in the art. However, a preferred embodiment of the present invention may include an inspection process that may take only about 10-15 minutes per railcar to briefly review the railcar. For railcars that may be stored within a repair shop, the inspection process may not be necessary as the railcar is likely reviewed during "inbound" or "outbound" inspections. Therefore, the information that may be required for the database may be completed via these inspection processes.

A main menu may be presented to a user of the data entry system. The main menu may comprise, for example, a list of possible options. These options may preferably be: 1) Car Condition Entry; 2) Add Inspector Name to List; 3) Cost Entry and Update; and 4) Print Reports and Forms. If a user wishes to print a blank form to be used in the inspection process, the user would select "4) Print Reports and Forms". A sub-menu would be preferably be presented to a user having the following options: 1) Blank Forms; 2) Car Condition Report; 3) Repair Cost & Disposition Report; and 4) Storage Location Inspection Report. If the user selects "1) Blank Forms", another sub-menu is presented to the user, whereupon the user may select blank forms for a plurality of different types of railcars, such as box cars, flat cars, hopper cars, general purpose tank cars, open top hopper and gondola car, plastic pellet car, pressure differential car, or a pressure tank car. The user may also be given the option to print blank forms for all types of cars. FIGS. 2-9 illustrate sample blank forms that may be printed from the system. Each form includes a listing of each railcar part that must be inspected by the inspector.

These blank forms include a plurality of areas for entering information relating to the condition of the parts of the railcar. Although any number of query types may be utilized on these blank forms, a preferred embodiment of the present invention includes two main types of queries for each of the railcar parts. First, queries involving the type of damage to particular parts of the railcars may be utilized. To simplify and standardize the responses to the first type of query, an inspector may respond to the first type of query by indicating whether the particular part has "minor" damage, "major damage" or "none" signifying that there is no damage to that particular part of the railcar. A second type of query may involve the condition of particular parts of the railcars. For simplicity and standardization, responses to the second type of query may include "poor", "fair" or "good", indicating that the condition of the particular part of the railcar is poor (meaning the part has one or more major defects), fair (meaning the part has one or more minor defects) or good (meaning the part has no defects and is useable). Of course, "minor" damage, "major" damage, or "none" (no damage), and "poor", "fair", or "good" are subjective terms and may be defined in any way that may be apparent to one having ordinary skill in the art.

Each part of the railcar may be assessed via the inspection process to determine qualitatively the condition of the part. The blank forms that may be utilized for the inspection process may be printed directly from the database via the "print forms" function, noted above. After the railcar has been assessed via the inspection process and the blank forms, the responses to the particular queries on the blank forms may be input into the data entry system for storage within the database. The data entry system may have fields for entering the information learned through the inspection step 10. The data may be input into the data entry system via an "Input Railcar Data in Data Entry System" step 12, as illustrated in FIG. 1.

Of course, the data may be entered into the data entry system in any way apparent to one having ordinary skill in the art, and the invention should not be limited as herein described. For example, an individual may utilize a personal digital assistant ("PDA"), or some other electronic device to directly enter the information relating to the rail equipment thereinto. The information may be stored on the PDA, or other electronic device, or transferred to another device for storage and for generating reports, as detailed below.

Once the assessment information is entered onto the forms, the information may then be stored within the database. The data entry system may then ensure that each entry into the data entry system is validly entered. The data entry system may then generate a repair disposition and repair cost estimation when all entries are completed. Reports may then be generated from the information entered in the data entry system. The reports may provide information such as the repair costs and particular availability of railcars as well as the locations of the railcars. Moreover, a user of the data entry system may have the ability to edit records, such as, for example, current records or history records.

The inspection step 10 may be implemented to collect railcar condition information into the car condition database via the data entry system. The railcars that may be inspected may include any and all railcars that may be owned or managed by an entity. Further, the railcars may be stored within storage depots, repair shops, and/or any other location apparent to those having ordinary skill in the art.

The inspection step 10 may include criteria and condition rating guidelines that may help to maintain consistency when assessing the general condition of the railcar equipment. Further, the inspection and data entry procedures may apply to a plurality of different types of railcars including, but not limited to, box cars, flat cars, hopper cars, general purpose tank cars, open top hopper and gondola cars, plastic pellet cars, pressure differential cars, pressure tank cars, and/or any other type of railcar that may be apparent to those having ordinary skill in the art.

Upon launching the data entry system, the user may be presented with a main menu, as noted above, and may have a choice as to whether he or she wishes to make a "Car Condition Entry", whether the user wishes to "Add an Inspector's Name" to the database, whether the user wishes submit "Cost Entry & Update", or whether, as noted above, the user wishes to "Print Reports & Forms". If the user wishes to add an inspector name to the database, he or she may choose that option and may thereby enter a name of the inspector via step 14 and save the inspector's name within the database. In a preferred embodiment of the present invention, an inspector's name may be entered only once into the database. Therefore, when a user wishes to enter an inspector's name into a particular data entry, he or she may choose the inspector from an "Inspector List" stored within the database so that he or she will not have to type the name in its entirety. Moreover, the user may view a complete list of names stored within the database. Further, descriptions may be stored with inspectors to uniquely identify and describe a particular inspector. The descriptions may be edited at any time. When finished entering inspectors' names, the user may return to the main menu 100.

In the main menu, the user may choose "Car Condition Entry" to enter information relating to a particular inspection of a railcar via step 16 whereupon the user may access or create Car Condition Inspection Records. The user may enter a car initial and/or a car number that may uniquely identify the railcar via step 18. Moreover, any other type of entry may be made to uniquely identify a particular railcar as may be apparent to one having ordinary skill in the art. Other information may be added within the Car Condition Inspection Records such as, for example, the inspection date via step 20. In a preferred embodiment of the present invention, the inspection date may default to the current date if no date is added within this field. After this preliminary information is added relating to a railcar inspection, the user may then choose to add a new record to the database via step 22. Alternatively, the user may choose to view past records to determine whether a record that has already been entered should be updated based on new information via step 24.

If the user opts to add a new record to the database, he or she may choose the type of railcar from a list of choices that may be displayed via step 26. The user should make certain that the railcar type that is chosen is the same as the blank form that was used during the inspection process. This will ensure that the information from the inspection is consistent with the record that is being added to the database. After the user has chosen a particular railcar type, he or she may choose an inspector name from the list of names that are stored within the database, as noted above, via step 28. Moreover, the user may enter the location of the inspection via step 30 so that the actual location where the inspection was performed is recorded within the database, whether at a repair shop or a storage depot or other storage location. Next, the storage location of the railcar may be entered via step 32. The storage location may be chosen from a list of storage locations or a storage location code may be entered.

Each part of the inspected railcar may have an associated field that may request a numeric value depending on the qualitative condition of the railcar part. These values may be entered into the database at this time. For example and as noted above, parts may be rated according to how much damage is present on the part, whether "minor", "major" or "none", and each of these choices may have an associated numeric value that may be entered into each field. Moreover, the qualitative conditions of railcar parts may be rated "poor", "fair" or "good" and an associated numeric value may be entered into the respective fields. The inspection data learned via the inspection step 10 may be entered via step 34, as shown in FIG. 2.

The following generic information relating to each type of railcar may be stored within the database: 1) the individual parts of each type of railcar that is rated as needing "major" or "minor" repair, and the associated average cost for each part, depending on whether the repair needed is "major" or "minor"; 2) whether each repair rating for each part constitutes a "mandatory" repair or an "optional" repair; and 3) whether the "major" or "minor" repairs constitute the need for an MRU, or shopping. A mandatory repair is a repair that must be done to the railcar prior to the railcar being delivered to a customer. Each repair that is mandatory is provided on a report that is generated via step 36, as shown below. Any optional repairs may be noted on the report by showing a type of flag, such as, for example, a "pound" sign or any other such designation, indicating on the report that optional repairs have also been noted. The optional repairs may not be included in the report unless the user indicates that they should be included in the report. In addition, the final estimated cost of repairing the railcars would not include the optional repairs unless indicated by the user that they should be included. It should be noted that not all "major" repairs needed for each part constitute the need for the railcar to be shopped. Some "major" repairs merely require an MRU to be dispatched to the railcar for repair. In addition, not all "minor" repairs can be fixed by the MRU, but must be shopped.

When all of the fields for each of the railcar parts have been entered into the data entry system via step 34, then a "Repair Disposition" report may be generated by the system via step 36 using the inputted information and the generic information relating to each type of railcar, and a numeric value may be generated that may correspond to three conditions: "Direct-to-Customer ("DTC")", "Mobile Repair Unit ("MRU")", or "Shop". If the numerical value representing "DTC" is generated via step 38, then the railcar can be shipped to a customer without taking any action on the railcar. If the numerical value representing "MRU" is generated via step 40, then a mobile repair unit may be sent to the storage location of the railcar to repair minor damage to the railcar. If the numerical value representing "Shop" is generated via step 42, then the railcar should be sent to a repair shop to repair major damage to the railcar.

The numerical values generated via steps 38, 40 or 42 are determined by the data entry system by summing all of the inputs for the various railcar parts. The system determines, based on the inputs, whether the railcar should be shopped, whether a mobile repair unit should be dispatched, or whether the railcar can be sent directly to the customer. Preferably, the disposition of the railcar will be based on the worst repair disposition for any of the railcar parts. For example, if all but one of the railcar parts require a mobile repair unit, but one requires the car to be shopped, then the entire car should be shopped. Of course, if no repairs are necessary on the railcar, or if the repairs are only cited as "optional" and the user chooses to ignore the optional repairs, then the railcar may be designated as Direct-to-Customer. Again, some repairs may be mandatory, whereas some repairs may be optional. Optional repairs will be noted, as described above, but will not be considered unless the user of the data entry system indicates that the optional repairs should be considered.

Moreover, an estimated total cost for repairing the railcar based on the repair needs of the railcar may be calculated via step 44 and saved with the record. Each part of each railcar may have an average cost of repair, depending on whether the part has minor damage, major damage, or is in fair or good condition, depending on how it is rated. The present invention sums the average costs for repairing each part, based on the condition of the part, and presents a total average cost for repairing the railcar.

The data entry system may automatically generate values for the repair disposition and the repair cost, which may be overridden by the user if necessary. A comment field may then be utilized by the user via step 46 to enter into the database any information that may be useful. In a preferred embodiment of the present invention, the comment field may be utilized to explain why the system-generated values for the repair disposition and/or the repair cost were overridden and changed. Further, the comment field may include any information regarding the condition of the car that may be useful to one having ordinary skill in the art.

If the user chooses to update records via step 24, as noted above, that have already been entered and stored within the database, then the user may recall the record via step 50 and change any information that may have been entered into the database via step 52. The record as shown by the data entry system may appear very similar to the blank record that may be utilized for entering a new record, except that the values for each field for each railcar part may already have values entered. These values may be changed by the user if necessary. The updated record may then proceed to step 36 to estimate a new repair disposition for the railcar.

New records or updated records may be saved into the database to be recalled at any time in the future via step 54. Moreover, reports may be generated showing conditions of railcars, locations of railcars, estimated costs to repair railcars, or any other type of information that may be apparent to one having ordinary skill in the art and that may be generated by the database.

EXAMPLES

The following shows specific values that may be stored within the database for costs of repairs and dispositions of the railcar (either MRU or Shop) depending on the type of damage to parts of the railcars. The following tables show individual railcar parts and repair costs for whether the parts require "major" repair or "minor" repair. In addition, the following tables show whether the repair to any part is mandatory or optional, as defined above. Further, the tables show the disposition depending on whether "major" or "minor" repair is needed for a part. These tables may be stored within the database and recalled by the data entry system when inputs are entered into the system. It should be noted that the costs associated with each part are estimated based on present-day values. Of course, any costs may be defined for each part, wheter the part erquires major repair or minor repair.

The tables include the following information: field description (i.e. "Boxcar part") describes the components and parts of the particular railcar that is inspected. The "Total Field" column assigns the repair cost for each component or part to various groups (1=Mechanical; 2=Lining Replacement; 3=Exterior Paint; 4=Interior Condition; 5=Lining Repair; and 6=Lining Preparation). The "Major Cost" column shows assigned average repair costs to perform the major repair on each part. The first "O/M" column indicates whether the major repair is mandatory ("M") or optional ("O"). The "Minor Cost column shows assigned average costs to perform the minor repair on each part. The next "O/M" column indicates whether the minor repair is mandatory ("M") or optional ("O"). The "Major Dispo" column shows the assigned repair dispositions (either Shop or MRU) for each repair if the repair is major. The "Minor Dispo" column shows the assigned repair dispositions (either Shop or MRU) for each repair if the repair is minor. The tables are as follows for Boxcars, Flat Cars, General Purpose Tank Cars, Hopper Cars, Open Top Hopper and Gondola Cars, Plastic Pellet Cars, Pressure Differential Cars, and Pressure Tank Cars.

TABLE 1

Boxcar Cost and Disposition Table

| Boxcar part | Total Field | Major Cost | O/M | Minor Cost | O/M | Major Dispo | Minor Dispo |
|---|---|---|---|---|---|---|---|
| Side sheet dents | 1 | 1,000.00 | M | 250 | O | Shop | MRU |
| Broken welds | 1 | 300 | M | 100 | O | MRU | MRU |
| Car body corrosion | 1 | 1,500.00 | M | 250 | O | Shop | MRU |
| End sheets bowed more than 4' | 1 | 1,200.00 | M | 250 | O | Shop | Shop |
| Side post interference with door o enin | 1 | 200.00 | M | 50.00 | M | Shop | Shop |
| Evidence of roof leakage | 1 | 300 | M | 100 | M | MRU | MRU |
| Load dividers inoperable | 1 | 800.00 | M | 250 | M | Shop | MRU |
| Broken or missing flooring | 1 | 900 | M | 100 | M | Shop | MRU |
| Light showing through floor | 4 | 300 | O | 50 | O | MRU | MRU |
| Protrusions | 1 | 250.00 | O | 50 | O | MRU | MRU |
| Dents > 1 inch | 1 | 600.00 | O | 50 | O | MRU | MRU |
| Missing caulk | 4 | 300 | O | 50 | O | MRU | MRU |
| Contamination-Leaks,odours,dirt,old commodity | 4 | 300 | O | 100 | O | MRU | MRU |
| Large dented areas | 1 | 500 | M | 200 | O | Shop | Shop |
| Loose broken welds | 1 | 200.00 | M | 50 | O | MRU | MRU |
| Sharp edges or protrusion over 1/8 inch | 1 | 200 | M | 50 | O | MRU | MRU |
| End lining bent over 4 inch | 1 | 600 | M | 200 | M | Shop | MRU |
| Broken or missing floor boards | 1 | 1,000.00 | M | 150 | O | Shop | MRU |
| Bent or broken doors tracks and retainers | 1 | 500 | M | 250 | M | Shop | MRU |
| Missing hardware | 1 | 300.00 | M | 100 | M | MRU | MRU |
| Door leaks | 1 | 300.00 | M | 50.00 | M | MRU | MRU |
| Inoperable Doors | 1 | 2,000.00 | M | 320 | M | Shop | MRU |
| Defective cushioning or draft uni | 1 | 3,000.00 | M | 600.00 | M | Shop | MRU |
| Friction casting wedge rise | 1 | 400 | M | 200 | O | Shop | Shop |
| Worn gibs | 1 | 500 | M | 300 | O | Shop | Shop |
| Broken springs | 1 | 100 | O | 50 | O | Shop | Shop |
| Defective center plates | 1 | 600.00 | M | 300 | O | Shop | Shop |
| Center sill bent | 1 | 2,000.00 | M | 500.00 | O | Shop | Shop |
| Customer logos | 3 | 300 | M | 50 | M | MRU | MRU |

TABLE 1-continued

Boxcar Cost and Disposition Table

| Boxcar part | Total Field | Major Cost | O/M | Minor Cost | O/M | Major Dispo | Minor Dispo |
|---|---|---|---|---|---|---|---|
| Graffiti | 3 | 500 | O | 125 | O | MRU | MRU |
| Paint condition | 3 | 1,800.00 | O | | | Shop | |
| Defects | 1 | 500.00 | M | 250 | M | MRU | MRU |

TABLE 2

Flat Car Cost and Disposition Table

| Flat Car Part | Total Field | Major Cost | O/M | Minor Cost | O/M | Major Dispo | Minor Dispo |
|---|---|---|---|---|---|---|---|
| Side sheet dents | 1 | 1,000.00 | M | 500 | O | Shop | MRU |
| Broken welds | 1 | 300 | M | 150 | M | MRU | MRU |
| Car bod corrosion | 1 | 1,500.00 | M | 500 | O | Shop | MRU |
| Trailer Hitches | 1 | 800.00 | M | 400 | M | Shop | Shop |
| Tie down and load restraining devices | 1 | 600.00 | M | 300.00 | M | Shop | Shop |
| Broken or missing flooring | 1 | 900 | M | 300 | M | Shop | MRU |
| Defective cushioning or draft units | 1 | 3,000.00 | M | 600.00 | M | Shop | MRU |
| Friction casting wedge rise | 1 | 400 | M | 200 | O | Shop | Shop |
| Worn gibs | 1 | 500 | M | 300 | O | Shop | Shop |
| Broken springs | 1 | 100 | O | 50 | O | Shop | Shop |
| Defective center plates | 1 | 600.00 | M | 300 | O | Shop | Shop |
| Center sill bent | 1 | 2,000.00 | M | 500.00 | M | Shop | Shop |
| Customer logos | 3 | 300 | M | 50 | M | MRU | MRU |
| Graffiti | 3 | 500 | O | 125 | O | MRU | MRU |
| Paint condition | 3 | 1,800.00 | O | | | Shop | |
| Defects | 1 | 500.00 | M | 250 | M | MRU | MRU |

TABLE 3

General Purpose Tank Car Cost and Disposition Table

| General Purpose Tank Car Part | Total Field | Major Cost | O/M | Minor Cost | O/M | Major Dispo | Minor Dispo |
|---|---|---|---|---|---|---|---|
| Shell bent or buckled | 1 | 4,000.00 | M | 500 | O | Shop | Shop |
| Jacket bent buckled or | 1 | 600 | M | 300 | O | Shop | MRU |
| Requires application of | 1 | 3,500.00 | O | 1,500.00 | O | Shop | Shop |
| Missing or defective caps | 1 | 150.00 | M | 50 | M | MRU | MRU |
| Missing or non approved valves | 1 | 500.00 | M | 100.00 | M | MRU | MRU |
| Corroded or inoperative valves | 1 | 500 | M | 100 | M | MRU | MRU |
| Requires eduction pipe reinforcement | 1 | 400.00 | M | | | Shop | |
| Gaskets worn,broken or missing | 1 | 500 | M | 150 | M | MRU | MRU |
| Lining condition | 2 | 3,200.00 | O | | | Shop | Shop |
| Rust bleed | 2 | 1,000.00 | O | 400 | O | Shop | Shop |
| Loose or flaking areas | 2 | 1,000.00 | O | 400 | O | Shop | Shop |
| Stains or discoloration | 2 | 1,000.00 | O | 400 | O | Shop | Shop |
| Rust | 4 | 2,000.00 | O | 800 | O | Shop | Shop |
| Corrosion | 4 | 5,000.00 | O | 500 | O | Shop | Shop |
| Interior residues or film | 4 | 900.00 | O | 500 | O | Shop | Shop |
| Water present | 4 | 300 | O | 100 | O | Shop | MRU |
| Porosity undercut welds | 2 | 400 | O | 150 | O | Shop | Shop |
| Brackets sharp edges or transitions | 2 | 300.000 | O | 100 | O | Shop | Shop |
| Friction casting wedge rise | 1 | 400 | M | 200 | O | Shop | Shop |
| Worn gibs | 1 | 500.00 | M | 300 | O | Shop | Shop |
| Broken springs | 1 | 100.00 | O | 50.00 | O | Shop | Shop |
| Defective center plates | 1 | 600.00 | M | 300 | O | Shop | Shop |
| Center sill bent | 1 | 800.00 | M | 500.00 | O | Shop | Shop |
| Customer logos | 3 | 300 | M | 50 | M | MRU | MRU |
| Graffitti | 3 | 500 | O | 125 | O | MRU | MRU |
| Commodity spillage | 3 | 500 | O | 200 | O | Shop | Shop |
| Paint condition | 3 | 1,800.00 | O | | | Shop | |
| Defects | 1 | 500.00 | M | 250.00 | M | MRU | MRU |

TABLE 4

Hopper Car Cost and Disposition Table

| Hopper Car Parts | Total Field | Major Cost | 0/ M | Minor Cost | O/ M | Major Dispo | Minor Dispo |
|---|---|---|---|---|---|---|---|
| Side sheet dents | 1 | 1,500.00 | M | 250 | O | Shop | MRU |
| Broken welds | 1 | 150 | M | 50 | O | MRU | MRU |
| Corrosion | 1 | 1,000.00 | M | 250 | O | MRU | MRU |
| Roof sheet buckles | 1 | 1,500.00 | M | 350 | O | Shop | Shop |
| Gates difficult to operate, need | 1 | 1,500.00 | M | 500 | M | Shop | MRU |
| Missing or defective hardware | 1 | 400 | M | 250 | M | Shop | MRU |
| Broken hatch covers | 1 | 1,200.00 | M | 350 | M | MRU | MRU |
| Hatch cover gaskets require attn. | 1 | 200 | M | 100 | M | MRU | MRU |
| Defective/Missing hatch cover | 1 | 550 | M | 75 | M | MRU | MRU |
| Lining condition | 2 | 2,500.00 | O | | | Shop | |
| Rust bleed | 2 | 800 | O | 400 | O | Shop | Shop |
| Loose or flaking areas | 2 | 800 | O | 400 | O | Shop | Shop |
| Stains or discoloration | 2 | 800 | O | 400 | O | Shop | Shop |
| Evidence of leaks | 1 | 250 | M | 125 | M | MRU | MRU |
| Broken Partition welds | 1 | 1,500.00 | O | 350 | O | Shop | MRU |
| Old commodity | 4 | 350 | M | 175 | M | MRU | MRU |
| Rust | 4 | 600 | M | 300 | M | Shop | Shop |
| Water Present | 4 | 500 | O | 125 | O | MRU | MRU |
| Porosity undercut welds | 2 | 600 | O | 275 | O | Shop | Shop |
| Brackets, sharp edges or transitions | 2 | 350 | O | 150 | O | Shop | Shop |
| Require seal welding | 2 | 4,000.00 | O | 2,000.00 | O | Shop | Shop |
| Deep discaloration from old commodity | 2 | 1,000.00 | O | 250 | O | Shop | Shop |
| Hammer Mark | 2 | 4,800.00 | O | 1,200.00 | O | Shop | Shop |
| Friction casting wedge rise | 1 | 400 | M | 200 | M | Shop | Shop |
| Worn gibs | 1 | 500 | M | 300 | M | Shop | Shop |
| Broken springs | 1 | 100 | O | 50 | O | Shop | Shop |
| Defective center plates | 1 | 600 | M | 300 | M | Shop | Shop |
| Center sill bent | 1 | 800 | M | 500 | M | Shop | Shop |
| Customer logos | 3 | 300 | M | 50 | M | MRU | MRU |
| Graffiti | 3 | 500 | O | 125 | O | MRU | MRU |
| Commodity spillage | 3 | 500 | M | 175 | O | Shop | MRU |
| Paint condition | 3 | 1,800.00 | O | | | Shop | |
| Defects | 1 | 500 | M | 250 | M | MRU | MRU |

TABLE 5

Open Top Hopper and Gondola Car Cost and Disposition Table

| Open Top Hopper and Gondola Car Part | Total Field | Major Cost | O/ M | Minor Cost | O M | Major Dispo | Minor Dispo |
|---|---|---|---|---|---|---|---|
| End and side sheets broken | 1 | 1,500.00 | M | 250 | O | Shop | MRU |
| End and side sheets bowed | 1 | 500 | M | 300 | O | Shop | Shop |
| Top chord bowed | 1 | 900.00 | M | 200.00 | O | Shop | Shop |
| Broken welds | 1 | 400.00 | M | 100 | O | MRU | MRU |
| Corrosion | 1 | 2,500.00 | M | 500.00 | O | Shop | Shop |
| Leaking gates | 1 | 2,400.00 | M | 225 | O | MRU | MRU |
| Gates inoperable | 1 | 3,000.00 | M | 600 | M | MRU | MRU |
| Broken floor sheets | 1 | 2,500.00 | M | 250 | M | Shop | MRU |
| Broken supports | 1 | 500.00 | M | 150 | M | MRU | MRU |
| Broken corner caps | 1 | 400.00 | M | 100 | M | MRU | MRU |
| Interior Corrosion | 4 | 3,000.00 | M | 500 | O | Shop | MRU |
| Old Commodity | 4 | 600.00 | O | 150 | O | MRU | MRU |
| Friction casting wedge rise | 1 | 400.00 | M | 200 | O | Shop | Shop |
| Worn gibs | 1 | 500.00 | M | 300 | O | Shop | Shop |
| Broken springs | 1 | 100.00 | O | 50 | O | Shop | Shop |
| Defective center plates | 1 | 600 | M | 300 | O | Shop | Shop |
| Center sill bent | 1 | 800 | M | 500 | O | Shop | Shop |
| Customer logos | 3 | 300.00 | M | 50 | M | MRU | MRU |
| Graffiti | 3 | 500 | O | 125 | O | Shop | MRU |
| Paint condition | 3 | 1,800.00 | O | | | Shop | |
| Defects | 1 | 500.00 | M | 250.0 | M | MRU | MRU |

TABLE 6

Plastic Pellet Car Cost and Disposition Table

| Plastic Pellet Car Part | Total Field | Major Cost | O/ M | Minor Cost | O M | Major Dispo | Minor Dispo |
|---|---|---|---|---|---|---|---|
| Side sheet dents | 1 | 2,500.00 | M | 250 | O | Shop | Shop |
| Broken welds | 1 | 150 | M | 150 | O | MRU | MRU |
| Corrosion | 1 | 1,000.00 | M | 500 | M | Shop | Shop |
| Roof sheet buckles | 1 | 1,500.00 | M | 350 | M | Shop | Shop |
| Gate need upgrade modification | 1 | 4,500.00 | M | 1,100.00 | M | Shop | Shop |
| Gates difficult to operate, need attn. | 1 | 700 | M | 350 | M | Shop | MRU |
| Missing or defective hardware | 1 | 400.00 | M | 200 | M | MRU | MRU |
| Gates & tubes req. buffing/other attn. | 1 | 750 | M | 500 | M | Shop | Shop |
| Requires vented hatch covers | 1 | 800 | M | 200 | M | MRU | MRU |
| Hatch covers require latch upgrade | 1 | 1,750.00 | M | 170 | M | MRU | MRU |
| Broken hatch covers | 1 | 1,750.00 | M | 170 | M | MRU | MRU |
| End vents require attn. | 1 | 200 | M | 100 | M | MRU | MRU |
| Manway rings require | 4 | 500 | M | 250 | M | Shop | Shop |
| Hatch cover gaskets require attn. | 1 | 250 | M | 25 | M | MRU | MRU |
| Lining condition | 2 | 2,500.00 | M | | | Shop | |
| Rust bleed | 2 | 800 | M | 400 | M | Shop | Shop |
| Loose or flaking areas | 2 | 800 | M | 400 | M | Shop | Shop |
| Stains or discoloration | 2 | 800 | M | 400 | O | Shop | Shop |
| Evidence of leaks | 1 | 250 | M | 125 | M | MRU | MRU |
| Broken Partition welds | 1 | 1,500.00 | M | 125 | M | Shop | MRU |
| Old commodity | 4 | 350.00 | M | 175.00 | M | Shop | MRU |
| Rust | 4 | 600.00 | M | 300 | M | Shop | Shop |
| Water Present | 4 | 500.00 | M | 250.00 | M | Shop | MRU |
| Porosity undercut welds | 2 | 600 | M | 300 | M | Shop | Shop |
| Brackets, sharp edges or transitions transitions | 2 | 350 | M | 150 | M | Shop | Shop |
| Intermitent or caulked welds | 2 | 300 | M | 150 | M | Shop | Shop |
| Deep discaloration from old commo | 2 | 1,000.00 | M | 500 | M | Shop | Shop |
| Hammer Mark | 1 | 4,800.00 | M | 1,200.00 | O | Shop | Shop |
| Friction casting wedge rise | 1 | 400 | M | 200 | O | Shop | Shop |
| Worn gibs | 1 | 500 | M | 300 | O | Shop | Shop |
| Broken springs | 1 | 100 | O | 50 | O | Shop | Shop |
| Defective center plates | 1 | 600.00 | M | 300 | M | Shop | Shop |
| Center sill bent | 1 | 800 | M | 500 | O | Shop | Shop |
| Customer logos | 3 | 300 | M | 50 | M | MRU | MRU |
| Graffiti | 3 | 500 | M | 125 | O | Shop | MRU |
| Commodity spillage | 3 | 500 | M | 150 | O | Shop | MRU |
| Paint condition | 3 | 1,800.00 | O | | | Shop | |
| Defects | 1 | 500 | M | 250 | M | MRU | MRU |

TABLE 7

Pressure Differential Car Cost and Disposition Table

| Pressure Differential Car Part | Total Field | Major Cost | O/ M | Minor Cost | O/ M | Major Dispo | Minor Dispo |
|---|---|---|---|---|---|---|---|
| Side sheet dents | 1 | 2,500.00 | M | 250 | O | Shop | Shop |
| Broken welds | 1 | 300 | M | 150 | O | MRU | MRU |
| Corrosion | 1 | 1,000.00 | M | 500.00 | O | Shop | Shop |
| Roof sheet buckles | 1 | 1,500.00 | M | 350 | O | Shop | Shop |
| Broken gage boxand hardware | 1 | 500.00 | M | 200.00 | M | MRU | MRU |
| Defective piping coupling | 1 | 1,500.00 | M | 250 | M | Shop | Shop |
| Butterly valves broken,sins of leakage | 1 | 600.00 | M | 150 | M | Shop | MRU |
| Defective blow down | 1 | 75.00 | M | 50 | M | MRU | MRU |
| Missing or defective pipe caps and gaskets | 1 | 250.00 | M | 100 | M | MRU | MRU |
| Wet and / or dirty aerator pads | 1 | 1,500.00 | M | 400 | M | Shop | Shop |
| Broken or stained aerator pads | 1 | 1,500.00 | M | 500 | M | Shop | Shop |

TABLE 7-continued

Pressure Differential Car Cost and Disposition Table

| Pressure Differential Car Part | Total Field | Major Cost | O/M | Minor Cost | O/M | Major Dispo | Minor Dispo |
|---|---|---|---|---|---|---|---|
| Defective or missing hatch | 1 | 375.00 | M | 50 | M | MRU | MRU |
| Defective or missing hatch | 1 | 250.00 | M | 75 | M | MRU | MRU |
| Broken hatch covers | 1 | 1,200.00 | M | 225 | M | MRU | MRU |
| Rust bleed | 2 | 1,000.00 | M | 500 | M | Shop | Shop |
| Loose or flaking areas | 2 | 1,000.00 | M | 500 | M | Shop | Shop |
| Stains or discoloration | 2 | 1,000.00 | M | 500 | O | Shop | Shop |
| Lining condition | 2 | 3,200.00 | O | Shop | | | |
| Evidence of leaks | 1 | 250 | M | 125 | M | MRU | MRU |
| Old commodity | 4 | 350.00 | M | 125 | M | Shop | MRU |
| Rust | 4 | 600.00 | M | 300.00 | O | Shop | Shop |
| Water Present | 4 | 500.00 | M | 250 | M | Shop | MRU |
| Porosity undercut welds | 2 | 600.00 | O | 300.00 | O | Shop | Shop |
| Brackets, sharp edges or transitions | 2 | 350 | O | 150 | O | Shop | Shop |
| Intermitent or caulked welds | 2 | 300 | O | 150 | O | Shop | Shop |
| Deep discaloration from old commodity | 2 | 1,000.00 | O | 500 | O | Shop | Shop |
| Hammer Mark | 2 | 4,800.00 | M | 1,200.00 | 0 | Shop | Shop |
| Friction casting wedge rise | 1 | 400.00 | M | 200.00 | O | Shop | Shop |
| Worn gibs | 1 | 500 | M | 300 | O | Shop | Shop |
| Broken springs | 1 | 100 | O | 50 | O | Shop | Shop |
| Defective center plates | 1 | 600.00 | M | 300 | O | Shop | Shop |
| Center still bent | 1 | 800.00 | M | 500 | O | Shop | Shop |
| Customer logos | 3 | 300 | M | 50 | M | MRU | MRU |
| Graffitti | 3 | 500 | O | 125 | O | Shop | MRU |
| Commodity spillage | 3 | 500 | M | 175 | O | Shop | MRU |
| Paint condition | 3 | 1,800.00 | O | | | | |
| Defects | 1 | 500.00 | M | 250 | M | MRU | MRU |

TABLE 8

Pressure Tank Car Cost and Disposition Table

| Pressure Tank Car Parts | Total Field | Major Cost | O/M | Minor Cost | O/M | Major Dispo | Minor Dispo |
|---|---|---|---|---|---|---|---|
| Shell bent or buckled | 1 | 4,000.00 | M | 500 | M | Shop | Shop |
| Jacket bent buckled or corroded | 1 | 600 | M | 300 | O | Shop | Shop |
| Missing or non approved valves | 1 | 350.00 | M | 100.00 | M | Shop | MRU |
| Corroded or inoperative valves | 1 | 500.00 | M | 100 | M | Shop | MRU |
| Missing or defective plugs and chains | 1 | 200.00 | M | 50.00 | M | Shop | MRU |
| Gaskets worn,broken or missing | 1 | 500.00 | M | 150 | M | Shop | Shop |
| Rust | 4 | 2,000.00 | M | 800 | O | Shop | Shop |
| Corrosion | 4 | 5,000.00 | M | 500 | M | Shop | Shop |
| Interior residues or film | 4 | 900.00 | M | 500 | M | Shop | Shop |
| Friction casting wedge rise | 1 | 400.00 | M | 200 | O | Shop | Shop |
| Worn gibs | 1 | 500.00 | M | 300 | O | Shop | Shop |
| Broken springs | 1 | 100.00 | O | 50 | O | Shop | Shop |
| Defective center plates | 1 | 600.00 | M | 300 | O | Shop | Shop |
| Center or stub sill bent | 1 | 800.00 | M | 500 | O | Shop | Shop |
| Customer logo's | 3 | 300.00 | M | 50 | M | Shop | MRU |
| Graffiti | 3 | 500.00 | M | 125 | O | Shop | MRU |
| Paint condition | 3 | 1,800.00 | O | | | Shop | |
| Exterior cleaning required | 3 | 500.00 | M | 300 | M | Shop | MRU |
| Thermobond protection repairs | 3 | 5,000.00 | M | 300 | M | Shop | MRU |
| Detects | 1 | 500.00 | M | 250 | M | Shop | MRU |

Therefore, a user of the data entry system may inspect a type of railcar and note damage done to individual parts of the railcar. The damage may be entered into the data entry system, which generates reports based on the information contained in Tables 1-9. The reports may show the average cost of the repair for the railcar, broken down by part, and whether the railcar should be shopped, whether an MRU should be dispatched to the railcar for repair, or whether the railcar can be shipped directly to the customer.

It should be noted that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. A method for inspecting rail equipment, storing information relating to the inspection and automatically generating a repair disposition report comprising:

providing rail equipment having a plurality of parts;

inspecting the rail equipment to determine a damage condition of each of the parts of the rail equipment;

providing a data entry system comprising a plurality of fields;

providing a database interconnected with the data entry system to store information input into the data entry system and generated by the data entry system;

querying a user of the data entry system for information relating to the damage condition of each of the parts of the rail equipment;

entering information relating to the damage condition of each of the parts of the rail equipment into each of the plurality of fields; and wherein the data entry system:

calculates an overall damage condition of the rail equipment from the information input into the data entry system;

automatically assigns one of a plurality of dispositions to the rail equipment based on the overall damage condition of the rail equipment, wherein the plurality of dispositions includes not repairing the rail equipment, repairing the rail equipment using a mobile repair unit and repairing the rail equipment at a repair facility, wherein the mobile repair unit is a vehicle equipped to provide mechanical services to the rail equipment without requiring the rail equipment to be moved to a repair facility; and generates at least one report showing the overall damage condition of the rail equipment and the disposition automatically assigned by the data entry system to the rail equipment.

2. The method of claim 1 wherein the report comprises information relating to an estimated cost of repair of the rail equipment.

3. The method of claim 1 wherein the data entry system stores information relating to a plurality of types of railcars.

4. The method of claim 3 wherein the railcars are selected from the group consisting of box cars, flat cars, hopper cars, general purpose tank cars, open top hopper and gondola cars, plastic pellet cars, pressure differential cars and pressure tank cars.

5. The method of claim 1 wherein the report comprises information related to whether the rail equipment must be repaired or whether the rail equipment is useable in its present state.

6. The method of claim 5 wherein the report further comprises information related to whether the rail equipment is repairable by a mobile repair unit or whether the rail equipment must be shopped.

7. The method of claim 1 further comprising the step of:

printing blank forms relating to the rail equipment from the data entry system.

8. The method of claim 1 further comprising the steps of:

assigning a damage indicator for each part of the rail equipment; and inputting the damage indicator for each part of the rail equipment into the data entry system.

9. The method of claim 1 further comprising the step of:

adding information into the data entry system relating to the inspector of the rail equipment.

10. The method of claim 1 wherein the information further comprises the identity of the rail equipment.

11. The method of claim 1 further comprising the step of:

selecting a record of rail equipment from the database;

editing information on the record of the rail equipment; and saving the information to the database.

* * * * *